US005163354A

United States Patent [19]

Bilodeau

[11] Patent Number: 5,163,354

[45] Date of Patent: Nov. 17, 1992

[54] SAFETY THROTTLE

[75] Inventor: Paul J. Bilodeau, Frankfort, N.Y.

[73] Assignee: Chicago Pneumatic Tool Company, Utica, N.Y.

[21] Appl. No.: 674,779

[22] Filed: Mar. 25, 1991

[51] Int. Cl.[5] ..... F15B 11/08

[52] U.S. Cl. ..... 91/428; 173/169; 173/170; 251/116

[58] Field of Search ..... 251/116, 109; 91/428; 173/169, 170; 74/102

[56] References Cited

U.S. PATENT DOCUMENTS

| | | | |
|---|---|---|---|
| 670,645 | 3/1901 | Soley | 173/170 X |
| 1,581,668 | 4/1926 | Bayles | 173/170 X |
| 3,060,894 | 10/1962 | Dean, Jr. et al. | 173/170 X |
| 4,018,292 | 4/1977 | Roll et al. | 251/109 X |
| 4,225,087 | 9/1980 | Lawlor | 251/116 X |
| 4,254,667 | 3/1981 | Wong | 251/109 X |

FOREIGN PATENT DOCUMENTS

| | | | |
|---|---|---|---|
| 11348 | 3/1956 | Fed. Rep. of Germany | 173/169 |
| 282000 | 7/1928 | United Kingdom | 173/170 |

*Primary Examiner*—Edward K. Look
*Assistant Examiner*—Todd Mattingly
*Attorney, Agent, or Firm*—Schmeiser, Morelle & Watts

[57] ABSTRACT

A safety throttle is provided for a hand held pneumatic tool in which a pivotable intermediate member must be manually moved, by a prior secondary movement, into a slotted throttle lever before the later primary movement of the throttle lever will allow the intermediate member to activate a throttle valve to actuate the pneumatic tool.

7 Claims, 3 Drawing Sheets

SAFETY THROTTLE

BACKGROUND OF THE INVENTION

1. Field of the Invention

This invention relates generally to a portable hand held power tool and more particularly to a safety throttle for use on pneumatic tools to prevent inadvertent actuation of the tool.

2. Description of the Prior Art

Prior art devices use a "lock-off" throttle where unintentional throttle valve actuation is avoided by preventing the motion of, or "locking" the throttle lever.

SUMMARY OF THE INVENTION

In accordance with the present invention a simple and rugged pneumatic hand tool is provided with a safety throttle in which the throttle contact is not in position to move until a safety lock is released or moved. The safety throttle of the present design is not easily bypassed by the operator or accidental movement of the tool.

The principle object of this invention is a throttle mechanism so constructed that the throttle lever cannot actuate the throttle valve from a rest condition without the proper positioning of an intermediate member, which requires a separate and distinct motion prior to normal depression of the throttle lever.

To elaborate, means are provided whereby the primary throttle manipulation is ineffective until a functionally necessary intermediate element is repositioned by a prior or preliminary secondary physical motion which then permits the primary throttle manipulation.

Further objects and advantages of the present invention will become apparent to those skilled in the art from the following detailed description and the accompanying drawings in which.

DETAILED DESCRIPTION OF THE INVENTION

Figure 2:
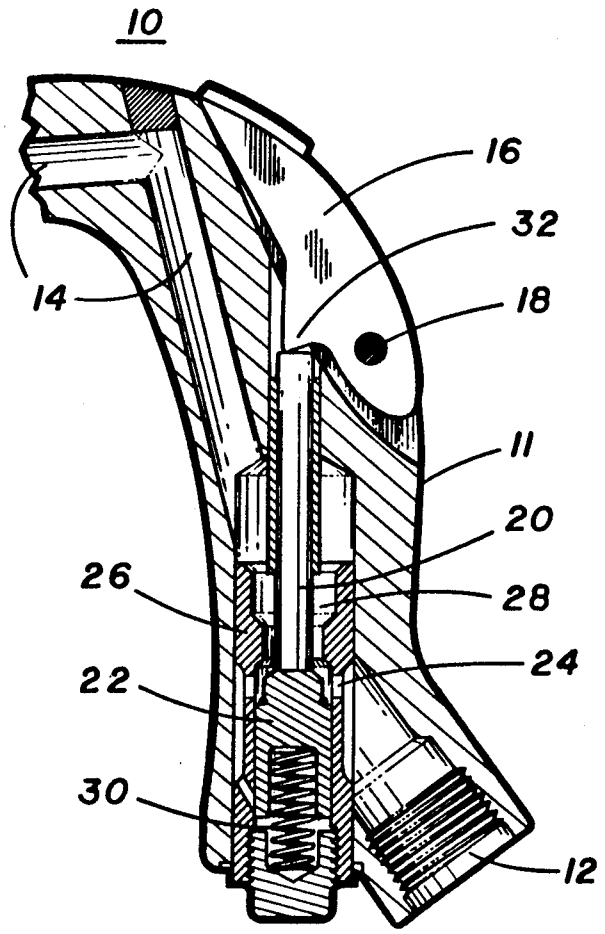
FIG. 2 PRIOR ART
FIG. 2 is a cross sectional view of the prior art apparatus of FIG. 1 showing the throttle lever in the full ON position.
Figure 1:
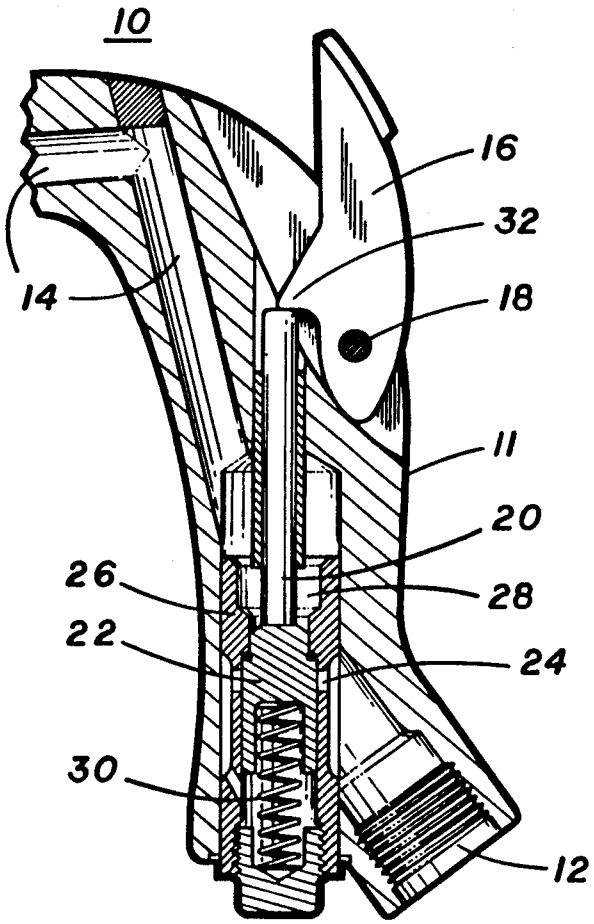
FIG. 1 PRIOR ART
FIG. 1 is a cross sectional view of a prior art throttle when the actuating lever or trigger is in the OFF position.

Referring to the drawings, FIGS. 1 and 2 show a cross sectional view of a prior art hand held pneumatic tool 10 having a body member 11 and in which air, from a source not shown, flows from tool inlet 12 to air passage 14 under control of an intermediate valve arrangement.

The intermediate valve arrangement of FIG. 1 shows the throttle lever 16 pivotable around the throttle lever pivot pin 18. As the throttle lever 16 is depressed or moved from right to left in FIG. 1, the throttle lever 16 pivots around throttle lever pin 18 to depress the throttle valve push pin or rod 20, which in turn unseats and opens throttle valve 22, as shown in FIG. 2. This allows air to flow from the tool inlet 12 through holes 24 in the valve tube 26, then through the annular space 28 between the valve push pin 20 and tube 26, and on through handle passage 14 to a piston cycling valve (not shown) which automatically directs the air to reciprocate the impacting piston of the tool 10.

Upon release of the throttle lever 16 valve spring 30 returns all parts to the rest position as shown in FIG. 1 and tool operation ceases. As may be seen in FIGS. 1 and 2 the triangular projection 32 on throttle lever 16 is always in a position to depress push pin 20 if lever 16 is moved forward from the rest position shown in FIG. 1.

It should be noted that accidental movement of the throttle lever 16 will permit air flow to air passage 14 accidentally. This invention is directed to preventing that, without locking the throttle valve lever 16 or push pin 20.

Figures 3, 4, 5:
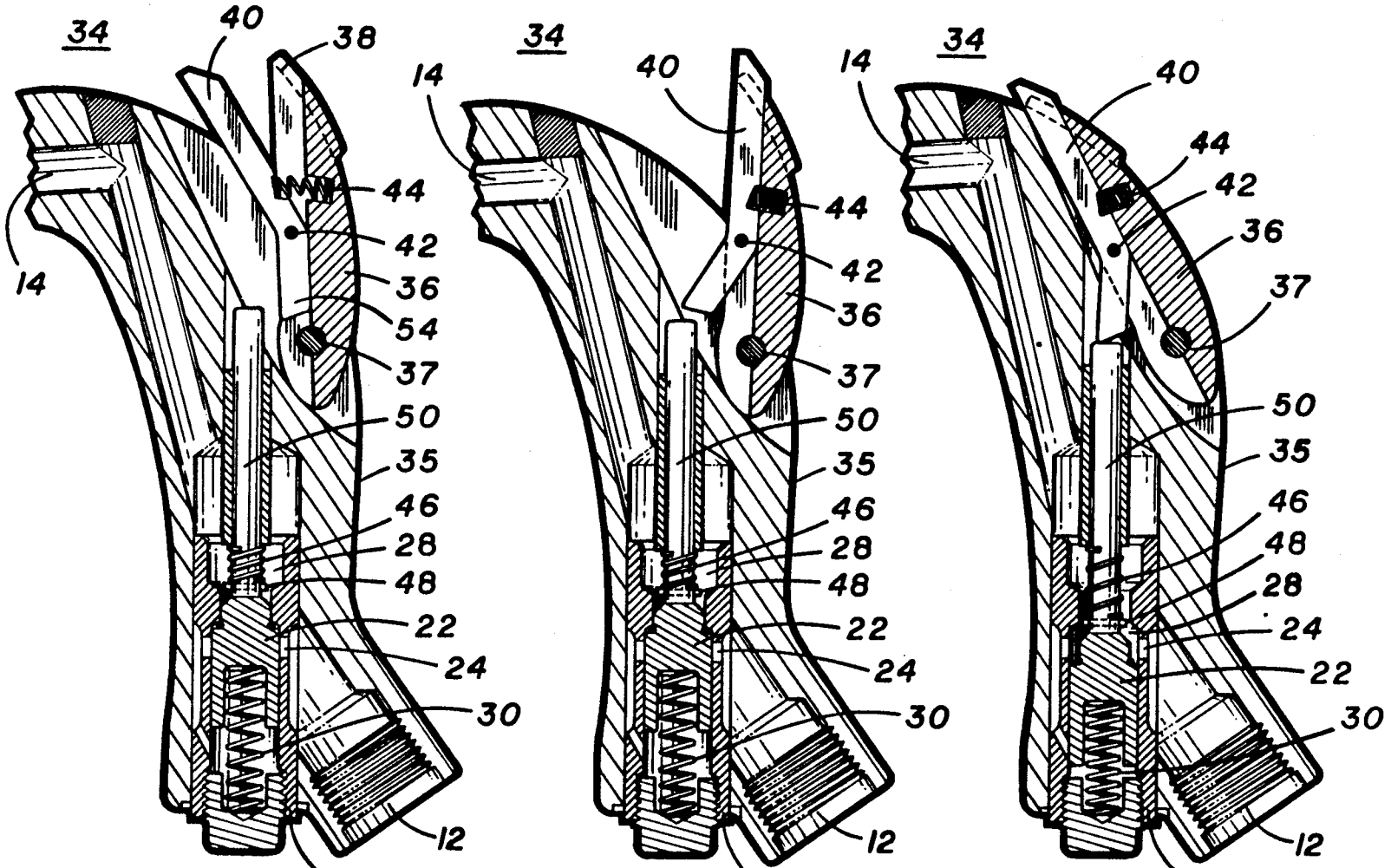
FIG. 3 is a cross sectional view of the apparatus of the present invention with the safety throttle in the OFF position.
FIG. 4 is a cross sectional view of the apparatus of the present invention showing the intermediate member moved toward a position to permit actuation of the throttle.
FIG. 5 is a further cross sectional view of the present invention showing the safety throttle in the full ON position.

The safety valve of the present invention will now be described with reference to FIGS. 3 to 7. The basic operation of the invention may be understood from a description of the cross-sectional FIGS. 3, 4 and 5. FIG. 3 illustrates the safety valve in the OFF position, FIG. 5 in the ON position and FIG. 4 in an intermediate position between those of FIGS. 3 and 5.

Referring to FIGS. 3, 4 and 5, the hand held tool 34 of the present invention has a body member 35 and includes the tool air inlet 12 and air passage 14 to the piston (not shown) as in the prior art device of FIGS. 1 and 2. Also, the throttle valve 22 and members 24, 26, 28 and 30 remain the same as the prior art device of FIGS. 1 and 2, for purposes of the first embodiment of the invention.

Figure 6:
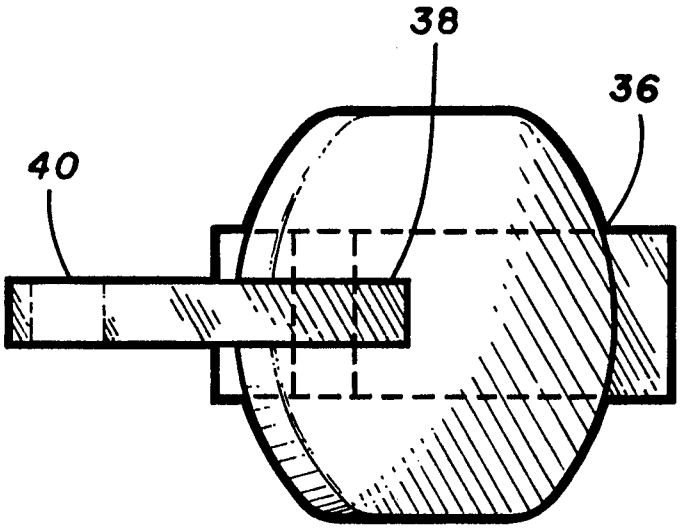
FIG. 6 is a partial top view of the present invention showing the throttle lever slotted to receive the intermediate member.

Throttle lever 36 of the present invention, pivotable around pin 37, no longer has the triangular projection 32 and has been slotted 38, as shown in FIG. 6 to accept the intermediate member 40. In this embodiment the intermediate member 40 has a shallow "v" shape with unequal length legs, and it pivots relative to throttle lever 36 on pin 42. A coil spring 44 constantly urges intermediate member 40 toward a rest position relative to throttle lever 36. In this position the upper leg portion of intermediate member 40 is pushed away from the throttle lever 36 while the lower leg of intermediate member 40 is urged against the throttle lever 36. The spring 44 is confined within lever 36 and acts against lever 36 and intermediate safety member 40.

Also shown in FIGS. 3, 4 and 5 are a spring 46 and a cross pin 48. The spring 46 is very light compared to valve spring 30 and serves only to retain push pin 50 and keep it in contact with throttle valve 22.

Figure 7:
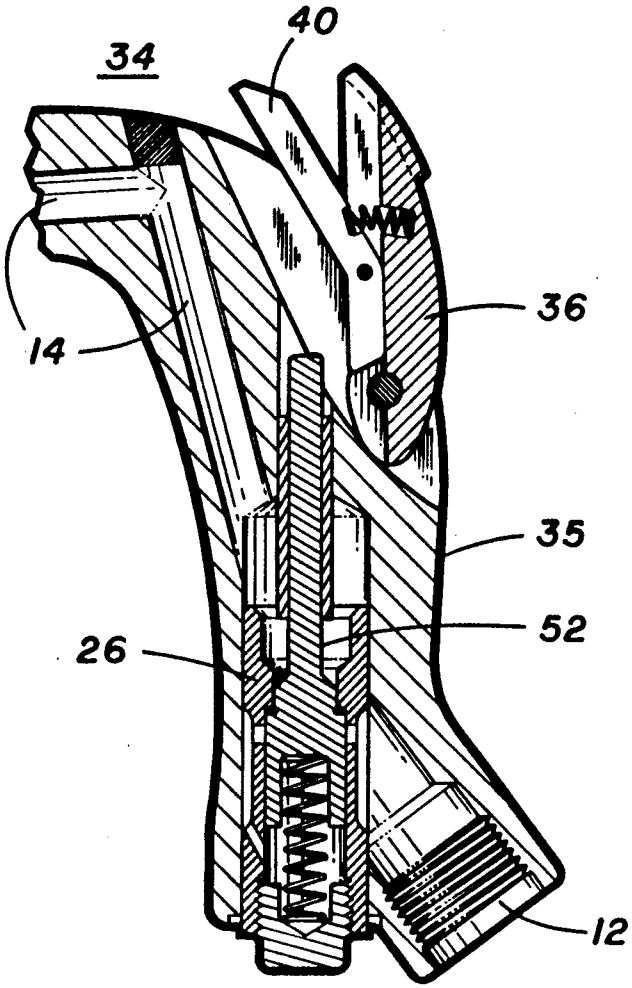
FIG. 7 is a cross-sectional view of an alternative embodiment of the invention showing a one-piece construction of the throttle valve.

It should be noted that spring 46 and cross pin 48 would be unnecessary if the throttle 22 and push pin 50 were made in one piece. This alternative embodiment is illustrated in FIG. 7 wherein the valve/pin member 52 represents the "one-piece" alternative to the arrangement illustrated in FIGS. 3, 4 and 5.

Returning now to FIG. 3, if throttle lever 36 is pressed forward toward the body 35 of the tool 10 the lower short leg 54 of intermediate member 40 will butt against the side of push pin 50 and cannot depress pin 50 to open the throttle valve 22. This acts as a safety arrangement to prevent accidental activation of the throttle valve 22.

In order for throttle lever 36 to cause the opening of the valve 22 the upper longer leg of intermediate safety member 40 must be pulled back toward and into the slot 38 in lever 36, with lever 36 also being pulled back from the tool 34 far enough to allow the end of the short leg 54 of intermediate member 40 to move to clear the top edge of push pin 50, and engage the top end of the push pin 50 when the throttle lever 36 is pressed forward toward the body 35 of the tool 34.

If these conditions are met, the short leg 54 of the intermediate member 40 becomes analagous to the triangular projection 32 on the standard lever 16 of prior art FIGS. 1 and 2, and throttle lever 36 of FIGS. 3, 4 and 5 affords complete control of the throttle valve 22 position from OFF, FIG. 3 to full ON, FIG. 5. When the throttle lever 36 is allowed to come back beyond the OFF position far enough to allow spring 44 to snap the end of the short leg 54 of intermediate member 40 off the top of push pin 50 the intermediate member 40 returns to the rest position as shown in FIG. 3. In the position shown in FIG. 3 the throttle lever 36 is incapable of actuating the throttle mechanism until intermediate member 40 and throttle lever 36 are reset as indicated above.

It is thus seen that the primary function of the throttle lever 36 being moved to open the throttle valve 22 depends on a prior secondary physical motion to reposition the intermediate safety element member 40 so as to allow the throttle lever to open the throttle.

It should be understood that variations and modifications of the described apparatus may be envisioned without departing from the spirit of the invention and scope of the claims.

What is claimed is:

1. Safety throttle means comprising a mechanical linkage means including a manipulable intermediate lever which renders normal primary throttle manipulation ineffective until the intermediate element is first repositioned, relative to a throttle valve actuator, by operator manipulation of said element from a non-functional, spring-biased safe position to a functional position between the primary throttle and the throttle valve actuator.

2. An improved method for using an intermediate linking member to control actuation of a throttle valve by a throttle lever, the improvement comprising initially rendering the throttle valve inoperative by removing an intermediate safe position-biased linking member from between the throttle valve and throttle lever, physically moving the intermediate linking member by an operator precursive movement and concurrently interposing the intermediate linking member between the throttle valve and throttle lever, thereby completing a mechanical linkage therebetween, moving the throttle lever to actuate the throttle valve, and releasing the throttle lever allowing the intermediate linking lever to be rebiased in a safe position causing thereby a regression to the rendering step.

3. Means for controlling a push rod activated throttle valve comprising;

a throttle valve responsive to movement of the aforesaid push rod;

a throttle lever having a pivot pin around which the throttle lever pivots, the said throttle lever having a slotted portion formed therein, and an intermediate V-shaped member having a pivot pin around which to pivot and having two leg portions which form the V, wherein when one leg portion is moved into the slotted portion of the throttle lever the other leg is positioned proximate the aforesaid throttle valve push rod so that movement of the throttle lever pivots an intermediate member leg to abut the push rod and move it to activate the throttle valve.

4. A safety throttle for a hand held pneumatic tool to prevent the accidental passage of air under pressure from activating the said pneumatic tool the safety throttle comprising, a pneumatic tool having a body and being selectively responsive to external air pressure for actuating the said tool, air passages through the tool, valve means for selectively controlling the flow of air under pressure through the tool, the said valve means including a push rod which, when moved longitudinally, activates the said valve means to permit the said external air pressure to actuate the said tool, a pivotable V-shaped intermediate safety member capable of being positioned with one portion of the V-shaped safety member in an abutting relationship with the said valve means push rod for controllably moving the said push rod, a pivotable slotted throttle lever for activating the said valve means when the throttle lever is moved toward the tool body, providing one leg of the said V-shaped intermediate pivotable safety member was previously pulled into the slotted throttle lever to permit positioning of the V-shaped leg proximate the valve means push rod, further movement of the said throttle lever displacing the V-shaped intermediate safety member so as to move the said push rod to activate the said valve means to permit air under pressure to actuate the said tool.

5. The apparatus of claim 4 wherein the said push rod and valve means are formed as one piece.

6. Safety throttle linkage means for alternately linking and unlinking a throttle lever with a throttle valve push rod, the linkage means comprising:

a pivotally mounted throttle lever having a slotted portion formed therein; and an intermediate angled member disposed at a pivot means in said slotted portion and further spring-biased thereto, the angled member further characterized by two diverging portions which depend from the pivot means wherein, when one diverging portion is first moved into the slotted portion of the throttle lever, the other diverging portion is positioned proximally said throttle valve push rod so that a second movement, comprising a movement of the throttle lever, pivots said other portion to abut the push rod and motivate it to actuate the throttle valve, whereby a subsequent retrograde movement of the throttle lever, in cooperation with spring-biasing of the angled member, causes the other diverging portion of the member to become positioned distally and non-abutting the push rod thereby isolating the throttle lever from the push rod.

7. Safety throttle means for use as a throttle lever-to-throttle valve push rod linkage and which maintains throttle lever actuation completely ineffective until a functionally necessary intermediate element is positioned by a prior discrete physical movement from a nonfunctional to a functional position, the safety throttle means comprising a pivotally mounted and safety biased intermediate lever means disposed between the throttle lever and the throttle valve push rod, the intermediate lever being operator movable from a nonfunctional, non-linking first position to a functional second position in which a portion of said intermediate lever is interposed between the throttle lever and the rod to create said linkage, and whereby upon a safety rebiasing, the intermediate lever portion retracts from interposition between the throttle lever and the rod, thus negating said linkage.

* * * * *